United States Patent [19]

Betro et al.

[11] Patent Number: 4,671,188

[45] Date of Patent: Jun. 9, 1987

[54] FOOT FOR EXPENDABLE CORRUGATED PALLETS

[75] Inventors: Joseph N. Betro, North Canton; George F. Smith; Vince M. Henry, both of Newark, all of Ohio

[73] Assignee: J. C. Baxter Co., Canton, Ohio

[21] Appl. No.: 917,709

[22] Filed: Oct. 10, 1986

[51] Int. Cl.[4] ..... B65D 19/12

[52] U.S. Cl. ..... 108/56.3; 108/51.3; 108/156; 108/902

[58] Field of Search ..... 108/56.1, 56.3, 51.3, 108/51.5, 156, 902; 24/291, 292, 297, 94, 596

[56] References Cited

U.S. PATENT DOCUMENTS

| | | | |
|---|---|---|---|
| 2,888,221 | 5/1959 | Connelly | 108/56.3 X |
| 3,316,861 | 5/1967 | Dailey | 108/56.3 |
| 3,605,651 | 9/1971 | Stewart | 108/56.3 |
| 3,610,172 | 10/1971 | Wharton | 108/56.3 |
| 3,804,032 | 4/1974 | Baucom | 108/56.3 |
| 4,425,852 | 1/1984 | Kiuiere | 108/56.3 |
| 4,534,088 | 8/1985 | Riche | 24/297 X |
| 4,597,338 | 7/1986 | Kreegar | 108/56.1 X |

FOREIGN PATENT DOCUMENTS

| | | | |
|---|---|---|---|
| 1112400 | 5/1968 | United Kingdom | 108/51.1 |

*Primary Examiner*—Kenneth Downey

*Attorney, Agent, or Firm*—Renner, Otto, Boisselle & Lyon

[57] ABSTRACT

A pallet having feet anchored to a platform by locking rings wherein each foot comprises a hollow tapered cup-like shape with a flange near the top of the foot, wherein the flange includes a plurality of slots, wherein each locking ring includes a flange of size and shape equal to the flanges of the feet, wherein each locking ring further includes a plurality of hooks which are insertable into the slots of the foot flange, and wherein the flange of each foot engages the underside of the platform while the flange of each locking ring engages the top side of the platform.

21 Claims, 11 Drawing Figures

FOOT FOR EXPENDABLE CORRUGATED PALLETS

TECHNICAL FIELD

The present invention relates to pallets and in particular to molded plastic feet for expendable pallets; and the invention also relates to a technique for securing the feet to the pallet board.

BACKGROUND OF THE INVENTION

Expendable pallets having molded plastic feet are known. Additionally, various configurations for attaching the feet to the platforms are known. The purpose of designing and intending a pallet to be expendable is to provide pallets which are lower in cost than conventional wooden pallets, yet are capable of supporting substantial weight. In spite of their low cost, some reuse is expected and therefore durability is also desirable and possible in expendable pallets.

One approach in designing expendable pallets has been to use molded plastic feet attached to a platform. The molded plastic feet provide the capability of the pallets to support substantial weight. The platform may be of lightweight material, such as cardboard, to maintain the pallet's configuration and to reduce the weight of the pallet.

U.S. Pat. No. 3,610,172 discloses molded plastic feet for an expendable pallet. There, a foot consists of a circular tapered cup portion having a flange extending outside the cup from the top and an annular ridge near the top. An open circular locking ring consists of a flange of the same size as that on the cup but with a downwardly depending body portion rim which extends into the cup. The body portion rim has an annular groove which cooperates with the annular ridge inside the cup to lock the two components together. The foot is inserted into a hole in the platform and the edges of the hole are sandwiched between the ring flange and the cup flange. Similarly, French Patent No. 2 411 136 shows a foot having a circular tapered cup portion and a locking ring with a downwardly depending body portion rim. However, such locking ring rim portion is longer than that of the U.S. Pat. No. 3,610,172 patent and has a plurality of raised annular ridges which cooperate with a plurality of annular grooves in the cup to lock the two pieces together.

U.S. Pat. No. 3,598,065 discloses a circular foot which is circumscribed at the top with a slot. The foot, which is tapered, is inserted into a hole and forced therethrough until the edges of the hole snap into the slot to secure the foot in the hole. No locking ring is needed. U.S. Pat. No. 3,664,272 shows another foot which is secured without a locking ring. A flange projects outwardly from the upper end of the foot and engages the upper surface of the platform. The foot is retained by lugs which project outwardly from the foot for engagement with the underside of the platform.

Yet another foot is disclosed by U.S. Pat. No. 4,425,852. There, the foot comprises a circular cup and includes a flange which engages the upper surface of the platform when the cup is inserted through a suitable hole. The cup has a circumferentially ridged shoulder portion which extends below the underside of the platform when the cup is inserted in its hole. A locking ring has a flange similar to the one on the cup which engages the underside of the platform. The ring has an annularly ridged skirt portion which cooperates with the ridged shoulder portion on the cup to lock the two pieces together, sandwiching the platform between them.

However, there are several disadvantages encountered in various ones of such prior art devices. For example, because the cardboard is susceptible to expansion and tearing, feet such as are disclosed in the '065 patent may too easily fall off. In others of the prior art devices the feet have a tendency to fall off after considerable weight is place on them because of the temporary physical deformities which occur when the cup is subject to great weight or such weight may cause the portions of the feet to come apart.

SUMMARY OF THE INVENTION

The invention is directed to a pallet having a platform or a load bearing surface and feet anchored to the platform. The feet comprise a cup-like portion with a flange extending outward from near the top of the cup. Locking rings having similarly sized flanges anchor the feet to the platform. Each cup flange includes a number of slots while each locking ring has an equal number of hooks which are inserted through the cup flange slots. A cup flange engages the underside of the platform while a locking ring flange engages the top side of the platform. The edge of the hole, through which a rim portion of the top of a cup is inserted, is sandwiched between the two flanges and the hooks maintain the sandwiching by grasping onto the underside of the cup flange.

Accordingly, an aspect of this invention is an expendable corrugated pallet with molded plastic feet that are easily assembled, remain in place as weight is applied, and do not separate in response to the applied weight. Another aspect of the invention is a pallet which is nestable and which integrates well with shrink and stretch film wrapping.

Yet another aspect of this invention is a pallet which reduces shipping costs because of its light weight and which reduces warehouse costs due to its nesting feature which reduces warehouse space. A further aspect is a pallet which costs a fraction of comparable heavy wooden pallets and less than other paper pallet products.

Two other aspects of the invention include the elimination of splinter and nail problems related to wooden pallets and four-way entry for easier material handling.

These and other objects, advantages and aspects will become more apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENT

Figure 1:
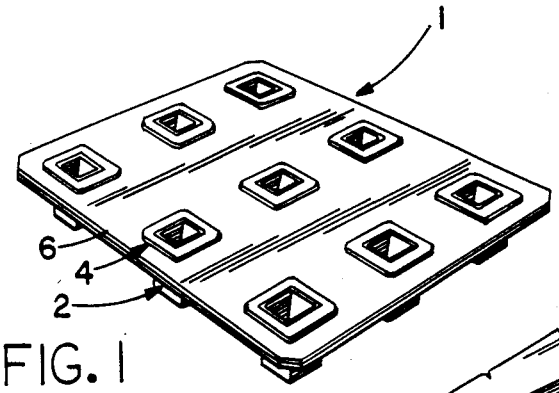
FIG. 1 is a perspective view of a pallet with feet.
Figure 2:
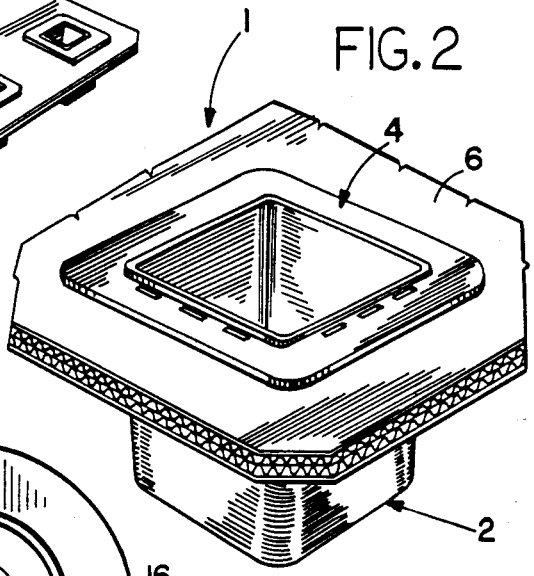
FIG. 2 is an enlarged view of a corner of a pallet with a foot.

A pallet 1 in accordance with the present invention is shown in both FIGS. 1 and 2. The pallet 1 includes a foot 2, a locking ring 4 and a platform 6. The foot 2 is hollow and tapered to allow for proper nesting of the pallets.

Figure 3:
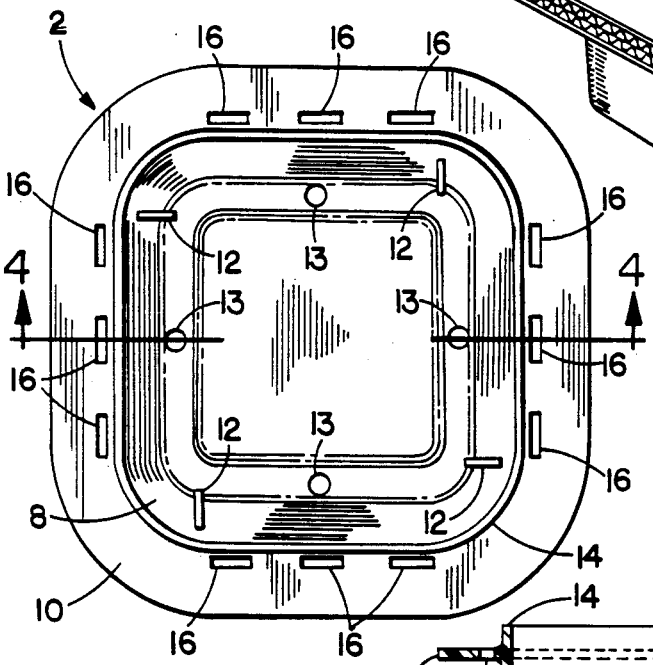
FIG. 3 is a top view of a foot.
Figure 4:
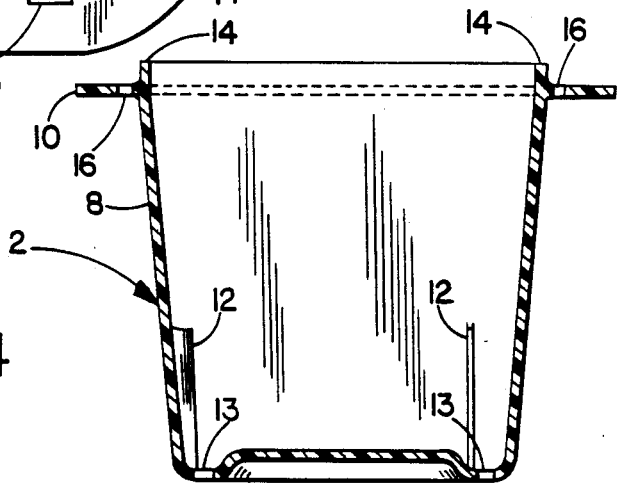
FIG. 4 is a section view of a foot looking generally in the direction of the arrows 4—4 of FIG. 3.
Figure 5:
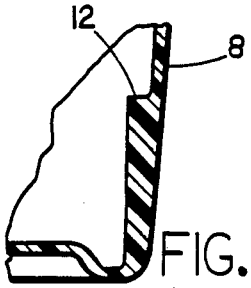
FIG. 5 is a section view of a corner of the bottom of a cup looking in the direction of the arrows 5—5 of FIG. 3.

The construction of the foot 2 is shown in more detail in FIGS. 3, 4 and 5. The foot 2 is preferably formed of a suitable molded thermoplastic or thermosetting material, for example, high-impact polystyrene, polypropylene or high density linear polyethylene, which are inherently rigid but which have some degree of elasticity to permit interlocking of the complemental locking elements of the locking ring 4 and the foot 2.

The foot 2 shown in FIGS. 2, 3, 4 and 5 includes hollow cup portion 8 and flange 10. The taper mentioned previously is evident in the side view illustration of cup portion 8 in FIG. 4. This taper of the cup portion allows for nesting of one foot inside of another. This in turn allows nesting of pallets for stacking a number of pallets in minimum space.

The cup portions 8 include stop fins 12 to limit the insertion of one foot inside another, so that the feet will not wedge together when they are stacked. The fins 12 project upwardly and inwardly within the cup portion 8. When the pallets are stacked, the fins 12 of each foot support the cup portions of the foot above.

Also included in the foot 2 are drain holes 13. The drain holes 13 prevent liquids from accumulating in the feet. Such accumulation would add not only unwanted extra weight to the pallets but could potentially accumulate in only certain feet rendering the pallet unbalanced.

Flange 10 projects horizontally outward from near the top edge of the cup portion 8. The flange is actually located a distance somewhat less than the thickness of the pallet platform 6 below the top edge of the cup portion 8. This leaves rim portion 14 sticking out above the flange 10. When the foot 2 is inserted into a suitable hole 15 in a platform 6, the rim portion 14 fits within the hole and the flange 10 engages the underside of the platform 6. When the locking ring 4 is put into place, that perimeter portion 16 of the platform surrounding the hole 15 in the platform 6 is sandwiched between the locking ring and the flange 10 to provide a tight grasp holding the foot in place to the platform. This would not be possible if the platform thickness were less than the height of rim portion 14 for reasons which will be discussed below.

With continuing reference to FIG. 3, the flange 10 is shown with aligned slots 16. In the preferred embodiment, aligned slots are used to minimize the gap needed between the foot and the edge of the hole 15 through which the rim portion 14 is inserted. As is discussed below, hooks on the locking ring access the slots 17 through this gap. However, non-aligned slots are contemplated by the invention.

Although in the preferred embodiment only three slots 16 are shown on each side of the flange 10, the invention can be configured with any number of slots per side. The function of the slots will become clear when the function of the lock ring is discussed below. As was mentioned above, it is preferred, too, that the slots on each side be aligned generally in a straight row or along a common line to facilitate locking and force balancing, described further below.

Figure 6:
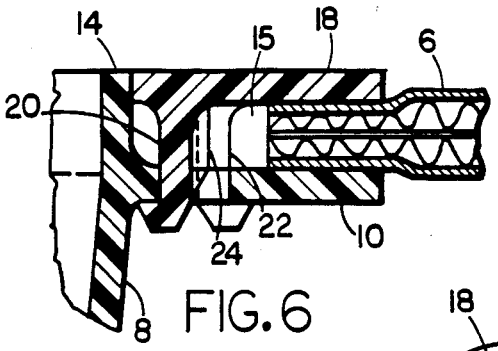
FIG. 6 is an enlarged view showing hooks engaging a foot flange.
Figure 7:
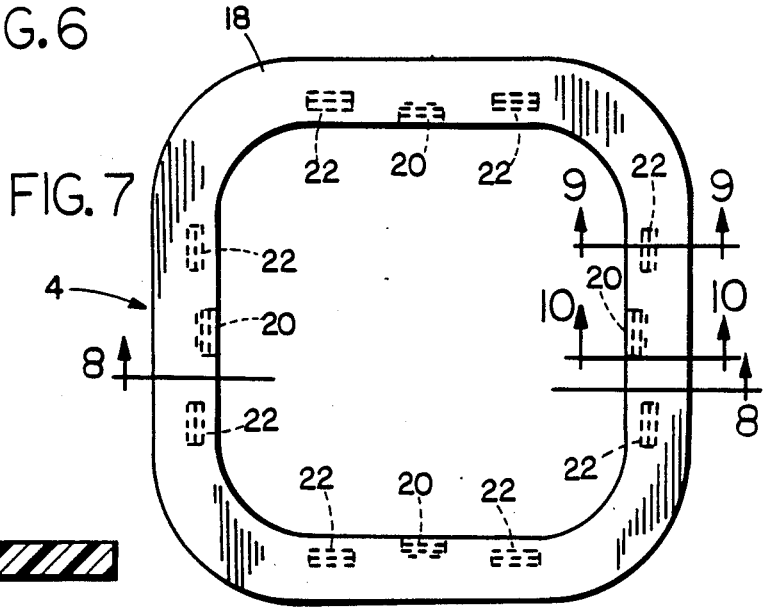
FIG. 7 is a top view of a locking ring.
Figure 9:
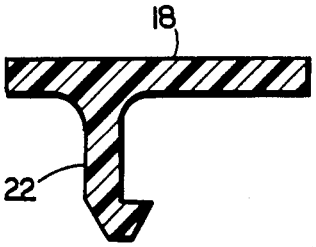
FIG. 9 is an enlarged sectional view of an outer hook.
Figure 8:
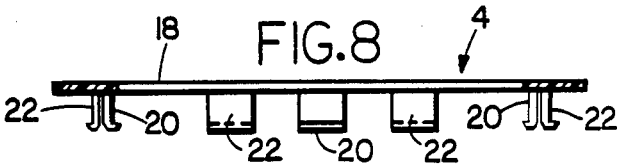
FIG. 8 is a side view of a locking ring looking in the direction of the arrows 8—8 of FIG. 7.
Figure 10:
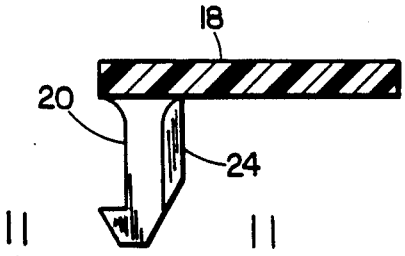
FIG. 10 is an enlarged view of a middle hook.
Figure 11:
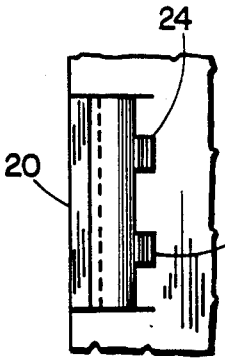
FIG. 11 is a bottom view of a middle hook.

In FIGS. 6, 7 and 8, the locking ring 4 is shown. The locking ring includes a flange 18 which is of equal aize and shape as the flange 10 of the cup portion 8. However, the sizes and shape of the flanges need not be equal as one skilled in the art can readily conceive of a multitude of variations which could be adequately substituted without departing from the invention. Also included on the locking ring is a series of hooks 20 and 22. Hooks 20 are the middle hooks in FIGS. 7 and 8, i.e. between a pair of outer hooks, and face toward the center of the ring. The hooks 22 are the outside hooks, i.e. they are closer the outside corners of the locking ring, and face toward the outside of the ring. Additionally, the hooks 22 are aligned with each other but are not aligned with the hooks 20.

The configuration difference between hooks 20 and hooks 22 is shown in FIGS. 6 and 8–11. The hooks 20 have two ribs 24. When a hook 20 is inserted through a slot 17 in the flange 10, the ribs force the hook tightly against the inside edge of the slot, to ensure a tighter grasp of the cup portion by the locking ring.

In FIG. 6 it is shown that the hole 15 in the platform 6 in which the foot 2 is received is slightly larger than the cross-sectional area of a top of the foot 2. When the locking ring 4 is put into place, the hooks 20 and 22 fit through the gap between the wall of the foot 2 and the edge of the hole 15 in the platform 6. The hooks 20 and 22 are then inserted in the slots 17 and are pushed therethrough until the hooks grab the underside of the flange 10. At this point the edge of the platform 6 is sandwiched between the flange of the lock ring and the flange of the cup portion tending to compress the platform material. However, the platform is made of somewhat resilient material, most preferably corrugation material, such as is commonly referred to as cardboard. This resiliency biases the platform toward its unsandwiched state. Such expansive forces force the lock ring away from the flange 10 to ensure in turn that the hooks grasp even more tightly due to the upward pressure of the hooks on the underside of the flange 10.

The dimensions of the hooks 20, 22 and the required spacing of the foot flange 10 and the locking ring flange 18 that assures the desired locking are such that there is some compression of the corrugation material to use the resiliency characteristics thereof as above without crushing such material that would appreciably reduce the strength thereof.

It is not necessary for the hooks to be inserted through a gap between a rim portion 14 and the edge of the hole through which the portion 14 is inserted. The hole could be cut smaller and slots could be cut into the platform to allow the hooks to extend through the platform. However, the cost of cutting such slots would only add to the total cost of the pallet which is contrary to its low cost appeal.

It can be appreciated that when a heavy load is placed on a pallet of the instant construction the hooks may be pushed slightly further downward but they will not release the foot. The hooks are resilient. As they are inserted into their respective slots, they are forced to bend slightly because of the taper on the end of the hooks. Once inserted, the hooks spring back to their unbent positions grasping the underside of the foot flange. When weight is placed on the pallet the hooks may be forced downward but they are not forced to bend away from their grasping position. Thus it is very difficult for the feet to fall off the pallet.

The effect of the forces exerted by the hooks once they are grasping a foot flange is to provide general balancing and centering of the locking ring with respect to the foot. The hook forces are uniformly distributed and pull the locking ring equally in all directions. This facilitates stacking and nesting because the feet are forced into centered positions within their respective holes. With the feet centered, the feet of one pallet will not be out of alignment with the feet of another pallet and the feet will nest perfectly.

While a preferred embodiment of the invention has been disclosed, it will be understood that various modifications obvious to those skilled in the art can be made thereto without departing from the spirit and scope of the invention as covered by the appended claims.

What is claimed is:

1. A pallet having a platform and feet attached to the platform by respective locking rings to space the platform from a surface wherein:

each foot comprising a hollow tapered cup-like portion having a cross-sectional area relatively proximate the bottom of the foot smaller than the cross-sectional area relatively proximate the top of the foot and a foot flange, said flange including a plurality of slots and said flange extending generally horizontally outward from the hollow cup-like portion of the foot and being spaced a distance below the top of the foot;

each locking ring comprising a flange and a plurality of hooks attached to the flange, said hooks being insertable into respective slots of a foot flange;

said platform having foot receiving holes, the feet being insertable into respective holes in the platform such that the upper surfaces of the foot flanges contact the underside of the platform; and the locking rings being attachable to repective feet to attach the feet to the platform, said locking ring being positioned around a respective hole on the top side of the platform such that the ring hooks extend through the platform and into the slots of the foot flanges until the hooks grasp the underside of the foot flanges.

2. A pallet as in claim 1 wherein the feet have identical symmetrical cross-sectional areas.

3. A pallet as in claim 2 wherein the feet have square cross-sectional areas.

4. A pallet as in claim 1 wherein the feet further comprise stopping means to stop complete insertion of one foot inside of another to prevent wedging of one foot inside of another during nesting.

5. A pallet as in claim 1 wherein the slots in the foot flanges are aligned.

6. A pallet as in claim 1 wherein the hooks of each locking ring are not aligned with each other.

7. A pallet as in claim 1 wherein some of the hooks of each locking ring face outwardly while the rest face inwardly.

8. A pallet as in claim 1 wherein some of the hooks of each locking ring further comprise means for pushing the hooks more tightly against an edge of a slot on a foot flange whenever the hook is inserted therethrough.

9. A pallet as in claim 1 wherein the distance of the foot flange from the top of the cup-like portion is less than the thickness of the platform.

10. A pallet as in claim 1 wherein the foot flanges and the locking ring flanges are substantially the same size and shape.

11. A pallet as in claim 1 wherein the feet and locking rings are made of a thermoplastic material.

12. A pallet as in claim 1 wherein the feet further comprise drainage holes in the bottom of the feet.

13. A foot structure for a pallet or the like, comprising a foot including a hollow tapered cup-like portion having a cross-sectional area relatively proximate the bottom of the foot smaller than the cross-sectional area relatively proximate the top of the foot and a foot flange, said flange including a plurality of slots and said flange extending generally horizontally outward from the hollow cup-like portion of the foot and being spaced a distance below the top of the foot; and a locking ring including a flange and a plurality of hooks attached to the flange, said hooks being insertable into respective slots of a foot flange; the foot being insertable into respective holes in a pallet platform such that the upper surfaces of the foot flanges contact the underside of the platform; and the locking rings being attachable to respective feet to attach the feet to such platform, said locking ring being positioned around a respective hole on the top side of such platform such that the ring hooks extend through such platform and into the slots of the foot flanges until the hooks grasp the underside of the foot flanges.

14. A foot structure as in claim 13 wherein the foot has a square cross-sectional area.

15. A foot structure as in claim 13 wherein the foot further comprises stopping means to stop complete insertion of one foot inside of another to prevent wedging of one foot inside of another during nesting.

16. A foot structure as in claim 13 wherein the slots in the foot flanges are aligned.

17. A foot structure as in claim 13 wherein some hooks of said locking ring are not aligned with each other.

18. A foot structure as in claim 17 wherein some of the hooks of said locking ring face outwardly while the rest face inwardly.

19. A foot structure as in claim 13 wherein some of the hooks of said locking ring further comprise means for pushing the hooks more tightly against an edge of a slot on a foot flange whenever the hook is inserted therethrough.

20. A foot structure as in claim 13 wherein the foot flanges and the locking ring flanges are substantially the same size and shape.

21. A foot structure as in claim 13 wherein the foot and locking ring are made of a thermoplastic material.

* * * * *